US007377662B1

(12) United States Patent
Bernstein et al.

(10) Patent No.: US 7,377,662 B1
(45) Date of Patent: May 27, 2008

(54) CHANGEABLE ILLUMINATED CANE TIP

(76) Inventors: Stephen R. Bernstein, 3318 Raintree Ave., Torrance, CA (US) 90505; Kevin J. Bernstein, 3318 Raintree Ave., Torrance, CA (US) 90505

( * ) Notice: Subject to any disclaimer, the term of this patent is extended or adjusted under 35 U.S.C. 154(b) by 171 days.

(21) Appl. No.: 11/111,162

(22) Filed: Apr. 21, 2005

Related U.S. Application Data

(60) Provisional application No. 60/564,367, filed on Apr. 22, 2004.

(51) Int. Cl.
*A45B 3/02* (2006.01)

(52) U.S. Cl. ..... 362/102; 135/910; 135/77

(58) Field of Classification Search ..... 362/102, 362/203, 802, 649, 205, 202, 171, 204; 135/65, 135/77, 84, 910
See application file for complete search history.

(56) References Cited

U.S. PATENT DOCUMENTS 1,595,023 A * 8/1926 Probe ..... 362/102
2,259,443 A * 10/1941 Geier ..... 362/102
3,461,448 A 8/1969 Kramer
4,099,535 A 7/1978 Hubachek
4,625,742 A * 12/1986 Phillips ..... 135/66
5,331,990 A 7/1994 Hall et al.
5,351,704 A 10/1994 Hunnicutt, Jr. et al.
5,588,735 A * 12/1996 Harada ..... 362/102
6,145,993 A 11/2000 Filippino
6,152,491 A * 11/2000 Queentry ..... 280/819
2002/0189657 A1* 12/2002 Yuan ..... 135/65
2004/0264172 A1* 12/2004 Roberts ..... 362/102

FOREIGN PATENT DOCUMENTS

DE 3811037 A1 * 10/1989

* cited by examiner

*Primary Examiner*—Hargobind Sawhney
*Assistant Examiner*—Kevin Spinella
(74) *Attorney, Agent, or Firm*—Kenneth L Tolar

(57) ABSTRACT

An illuminable, interchangeable water-resistant tip for a walking cane includes a housing that is adapted to be attached to a lower end of a walking cane. The housing includes a shroud at an upper end that is superimposed on a plurality of peripherally positioned LED's. By placing the housing on the ground and rotating the cane, a user can activate the LED's with an internal switch means to assist a user with ambulating in darkness.

4 Claims, 1 Drawing Sheet

CHANGEABLE ILLUMINATED CANE TIP

CROSS REFERENCE TO RELATED APPLICATIONS

This application is entitled to the benefit of provisional application No. 60/564,367 filed on Apr. 22, 2004.

BACKGROUND OF THE INVENTION

The present invention relates to a lighted, interchangeable tip for a walking cane allowing a user to more easily ambulate in darkness.

DESCRIPTION OF THE PRIOR ART

Many people such as the elderly, infirm or disabled can only walk with the assistance of a cane, crutches or a walker; however, such devices are of little use in darkness where visibility may be limited. Accordingly, there is currently a need for increasing the effectiveness of such devices in darkness. Several illuminated walking canes and the like exist in the prior art. For example, U.S. Pat. No. 3,461,448 issued to Kramer discloses a lamp signaling device which can be mounted on a support such as an umbrella. The device includes a siren and a battery-powered motor that rotates a reflector and a signal flag.

U.S. Pat. No. 4,099,535 issued to Hubachek discloses a light emitting walking cane including an elongated tubular shaft constructed with a translucent material. The portion of the shaft above the cane tip is exposed to provide a window for the emission of light. A solid rod of light conducting material is positioned within the tubular shaft. The rod includes a roughened outer surface that diffuses light axially along the shaft towards the exposed portion thereof.

U.S. Pat. No. 5,331,990 issued to Hall, et al. discloses a safety cane incorporating an ambient light sensitive illumination device for conserving power. A tipping detector activates an alarm after a first predetermined time delay. If the cane is not retrieved upon the expiration of a second time delay, the cane initiates an instruction to a telephone dialing device.

U.S. Pat. No. 5,351,704 issued to Hunnicutt, Jr., et al. discloses an illuminating walking cane having a translucent portion at a lower end. The cane also includes a light source positioned within the cane shaft that is activated with a push button switch on a handle.

U.S. Pat. No. 6,145,993 issued to Filippino discloses an illuminated cane tip for attachment to a conventional walking cane. The device includes a housing securable to a lower end of a cane that includes a battery, a light bulb and conductive wires. The light is activated with a push button switch extending from the housing.

Though the device disclosed in Filippino relates to an illuminated cane tip for attachment to a cane, the light is manually activated with a switch positioned on the shaft. Operating or even locating such a switch by a disabled, visually impaired or handicapped person may be difficult, if not impossible. The present invention provides a uniquely designed, replaceable tip for a walking cane having a light that can be selectively illuminated in darkness. The light is activated by placing the tip on the ground and rotating the cane shaft eliminating the need to stoop, kneel or otherwise search in order to operate the switch.

SUMMARY OF THE INVENTION

The present invention relates to an illuminable, replaceable tip for a walking cane. The device comprises a housing adapted to be securely attached to a lower end of the cane including a shroud superimposed on a plurality of LED's. The LED's are activated with a switch means that includes an outer cylinder fixedly attached to an upper portion of the housing that is electrically connected to a power source. Concentrically received within the outer cylinder is an insulating sleeve and an inner cylinder that is fixedly attached to a lower portion of the housing. The inner cylinder includes an electrically conductive outer surface with a microprocessor connected thereto which is in turn connected to the LED's. The outer cylinder includes a pair of staggered contacts disposed on the interior surface thereof. The insulator includes a pair of openings whereby the upper cylinder is rotated until a contact seats within one of the insulator openings to establish electrical communication between the upper and lower cylinders. Accordingly, by placing the tip on the ground and rotating the upper portion of the cane, a user can establish electrical communication between the microprocessor, battery and LEDs thereby illuminating the lower end of the cane.

It is therefore an object of the present invention to provide a replaceable tip for a walking cane that can assist a user in walking in darkness.

It is another object of the present invention to provide a tip for a walking cane that can be illuminated.

It is yet another object of the present invention to provide an illuminating tip for a walking cane that is conveniently activated with an easily operable switch means.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
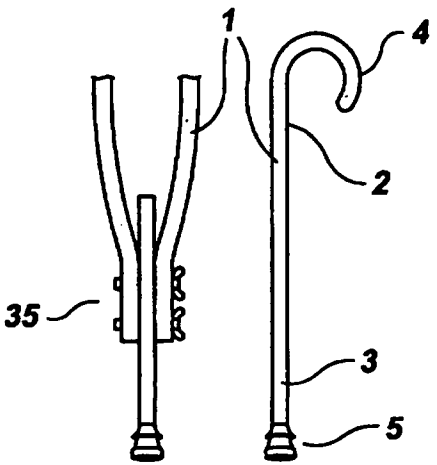
FIG. 1 is a plan view of a walking cane with the interchangeable tip secured thereto.

Now referring to FIGS. 1-5, the present invention relates to an interchangeable, water-resistant illuminating tip for a walking cane. A conventional walking cane as depicted in FIG. 1 includes an elongated shaft 1 having an upper end 2 and a lower end 3. At the upper end is a handle 4 member that can be grasped by a user. The present invention relates to an illuminating tip, generally depicted at 5, that can be removably attached to the lower end of a cane as described above, or another similar device such as a walker type cane or a crutch 35.

The tip includes a unitary housing 25 having an upper end and a lower end; the upper end is adapted to be securely fastened to the lower end of the cane in a conventional manner. At the lower end is a foot member 11 that normally engages the ground when the cane is in use. Near the upper end of the housing is a shroud 6 superimposed on a plurality of LED's 7 that are activated with a uniquely designed switch means 40.

Figure 3:
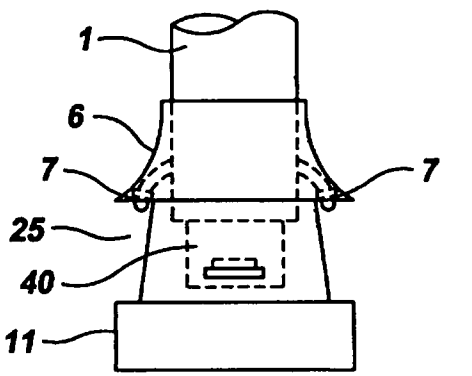
FIG. 3 is a plan view of the walking cane tip.
Figure 2:
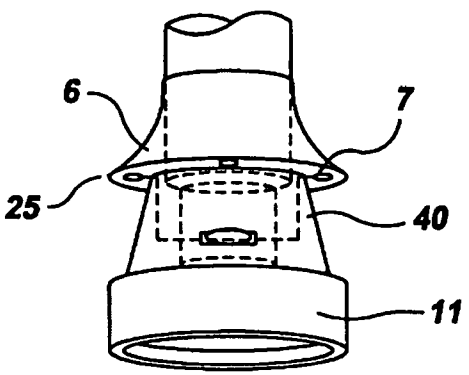
FIG. 2 is a detailed view of the lower end of the walking cane.
Figure 5:
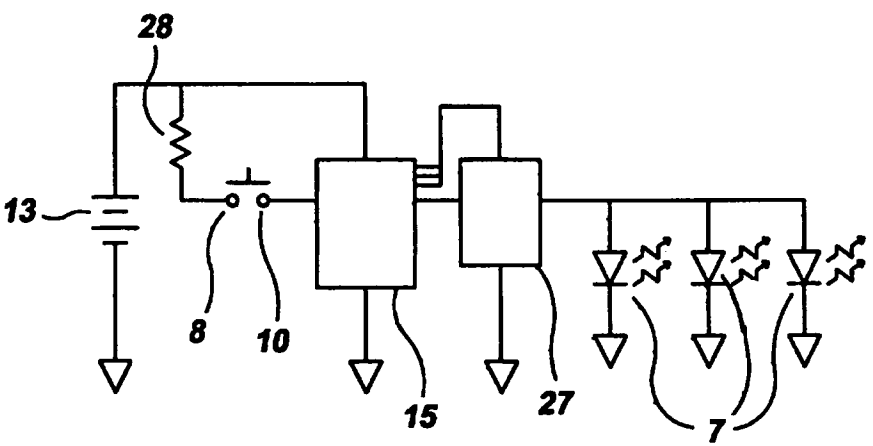
FIG. 5 is a schematic of the various electrical components according to the present invention.
Figure 4:
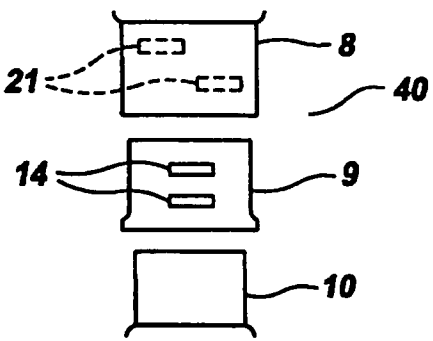
FIG. 4 is an exploded view of the switch means.

Now referring specifically to FIGS. 4 and 5, the switch means includes a hollow, outer cylinder 8 received within the housing that is fixedly attached to an upper portion thereof. The outer cylinder includes a pair of staggered contacts 21 disposed on an inner surface thereof which are electrically connected to a battery 13 and a flex circuit resistor 28.

Concentrically received within the outer cylinder is an inner cylinder 10 with an insulating sleeve 9 therebetween. The inner cylinder is fixedly attached to a lower portion of the housing. The inner cylinder includes an electrically conductive outer surface that is electrically connected to a microprocessor 15 which is turn connected to the battery 13, an LED driver 27 and the LED's 7. The insulator includes a pair of tiered openings 14 whereby the outer cylinder can be rotated until one of the contacts seats within one of the openings to establish electrical communication between the upper and lower cylinders. Upon receiving the requisite signal from the battery, the microprocessor is activated which in turn activates the LED's. The staggered contacts in combination with the tiered openings require minimal rotation of the outer cylinder in order to position one of the contacts within one of the openings.

The microprocessor is programmed to maintain the LED's in an illuminated state for a predetermined duration, i.e. 30 seconds, after which time the LED's are automatically disabled and the microprocessor returns to a dormant state. Furthermore, the microprocessor cycles the LED's at approximately 50% to conserve battery life; the cycle rate is fast enough so as to be indiscernible by the human eye.

To use the above described device, the existing cane tip is removed and the above described assembly is slidably mounted on the lower end of the cane shaft. By placing the foot member on the ground and rotating the cane shaft, a user can activate the LED's thereby illuminating the lower end of the cane. The resiliency of the tip housing causes the switch to immediately return to its normal, open position. The microprocessor will maintain the LED's in an illuminated state for the preprogrammed duration after which time they will be automatically disabled. When the tip assembly becomes worn or inoperable, a new tip assembly can be easily substituted therefor.

The above described device is not limited to the exact details of construction and enumeration of parts set forth herein. For example, though the tip assembly is primarily depicted and described as being for a walking cane, it can also be attached to a crutch, a walker or any other similar medical device. The tip housing, including the shroud, is preferably constructed with a resilient but slightly pliable material such as rubber; however, the size, shape and materials of construction of the various components can be varied. Furthermore, the active duration and the cycling frequency of the LED's can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An illuminating tip attached to a walking assistance device comprising:

a housing having means for securing to a walking assistance device;

a plurality of lights positioned on said housing;

a switch means for activating said lights when said housing is anchored on an underlying surface and said walking assistance device is rotated to illuminate a surrounding area, wherein said switch means includes a hollow, outer cylinder received within the housing that is fixedly attached to an upper portion thereof, said outer cylinder including at least one contact thereon, said contact in communication with a power source, an inner cylinder fixedly attached to a lower portion of the housing and received within the outer cylinder; said inner cylinder including an electrically conductive outer surface, an insulating sleeve between said inner cylinder and said outer cylinder, said insulating sleeve having at least one opening thereon, a microprocessor electrically connected to the conductive outer surface of said inner cylinder and said lights whereby the outer cylinder is rotated until the contact seats within the opening to actuate said microprocessor which in turn activates said lights.

2. The illuminating tip according to claim 1 wherein said microprocessor is programmed to maintain the lights in an illuminated state for a predetermined duration.

3. The illuminating tip according to claim 1 wherein the microprocessor cycles the lights at a predetermined frequency to conserve energy.

4. The illuminating tip according to claim 1 wherein said housing includes a protective shroud superimposed on said lights.

* * * * *